US006742546B2

(12) United States Patent
Debaes et al.

(10) Patent No.: US 6,742,546 B2
(45) Date of Patent: Jun. 1, 2004

(54) FACE-TO-FACE WEAVING MACHINE WITHOUT REAR TRAVERSE

(75) Inventors: Johnny Debaes, Moorslede (BE); Ferdi Dejaegere, Dadizele (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/106,322

(22) Filed: Mar. 27, 2002

(65) Prior Publication Data

US 2002/0153052 A1 Oct. 24, 2002

(30) Foreign Application Priority Data

Apr. 20, 2001 (BE) ..... 2001/0267

(51) Int. Cl.[7] ..... D03D 39/16
(52) U.S. Cl. ..... 139/21; 139/391; 139/1 R
(58) Field of Search ..... 139/1 R, 391, 139/21

(56) References Cited

U.S. PATENT DOCUMENTS 2,142,025 A * 12/1938 Hall, Jr. ..... 139/21
3,394,739 A * 7/1968 Crenshaw et al. ..... 139/21

FOREIGN PATENT DOCUMENTS

WO WO 96/23093 8/1996

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A face-to-face weaving machine with face-to-face shed forming has a passage for, and access to, the weaving frames without being hampered by a rear traverse. The face-to-face weaving machine with face-to-face shed forming is provided in which the weaving machine has no rear traverse.

1 Claim, 2 Drawing Sheets

FACE-TO-FACE WEAVING MACHINE WITHOUT REAR TRAVERSE

Figure 1:
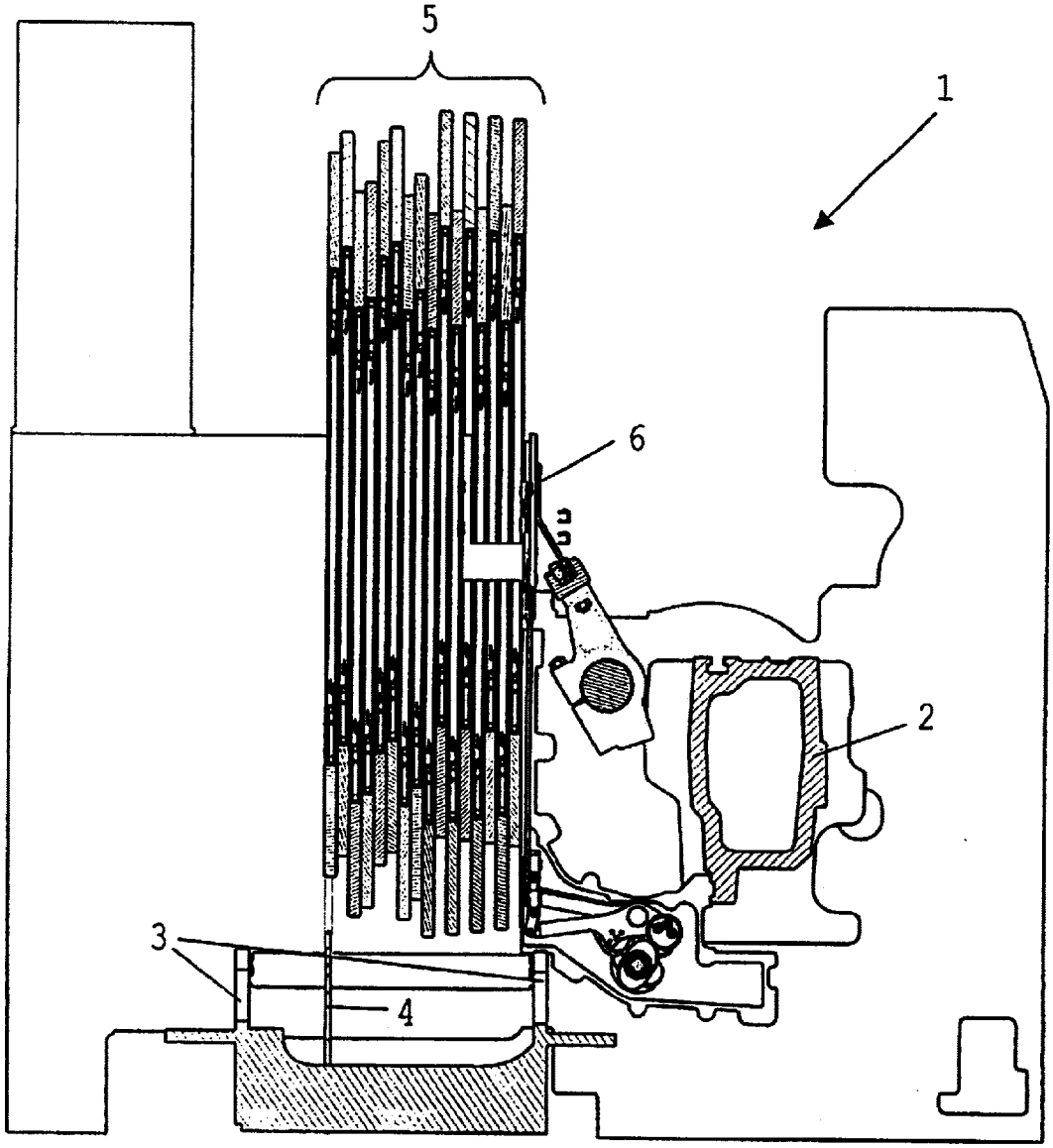

This invention relates to a face-to-face weaving machine with face-to-face shed forming.

Up to this moment, the frames of face-to-face weaving machines are connected to each other by a front and a rear transverse in order to give the face-to-face weaving machine sufficient stability. In the space between the front and the rear transverse of a face-to-face-weaving machine there is the set of weaving frames for the face-to-face shed forming of the warp yarns. When putting on a new fabric or in case of a fabric change an adapted set of weaving frames with a heddling specific for that fabric must be brought into the face-to-face weaving machine.

There are two ways in which the weaving frames can be brought into and removed from the face-to-face weaving machines. A first method is to lower the weaving frames from above between the two traverses or to lift them up in the opposite direction to remove the set of weaving frames.

A disadvantage of this method is that the heddles of the weaving frames cannot be heddled with previously tied up warp yarns, because of which the heddling should occur in the face-to-face weaving machine itself.

A second method consists in keeping the complete set of weaving frames in a well tilted position and to shift it forward above the back traverse and once it has passed the back traverse, to hang it in a perpendicular position to lower it between the two traverses. Removing the weaving frames then takes place in the opposite direction.

With this method the warp yarns can already been heddled, but the disadvantage of this method is that tilting the set of weaving frames each time causes the entanglement and damaging of the warp yarns because of the elaborate handling.

An additional disadvantage is that when removing or replacing the weaving frames access is required to the driving rod big ends which have their bearings in the lower weaving frame. To this end, these driving rod big ends must be loosened and fastened. The access to these fastening points is made difficult by the presence of a rear traverse in a face-to-face weaving machine.

The purpose of this invention is to provide a face-to-face weaving machine, which has none of the disadvantages, mentioned above.

This purpose is attained by providing a face-to-face weaving machine with face-to-face shed forming, where the face-to-face weaving machine does not comprise a rear traverse.

The advantage of this machine is that the back traverse does no longer hamper the passage of and the access to the weaving frames.

In a preferred embodiment of the face-to-face weaving machine according to the invention the face-to-face weaving machine comprises a weaving reed and a set of weaving frames, in which the weaving reed is attached to the front of the set of weaving frames and where the set of weaving frames, together with the weaving reed, fully heddled with warp yarns, in an upright position without any tilting movement, can be brought into the face-to-face weaving machine by a horizontal shift.

The advantage if this arrangement is that a tilting movement is no longer required and an entanglement of or any damage to the warp yarns can be avoided. An additional advantage is, that the heddling can occur entirely outside the face-to-face weaving machine and that replacing a fabric or a change of fabric can be thoroughly prepared and carried out in a very short time. And another advantage yet is that a good access is provided to the driving rod big ends of the weaving frames.

This invention is further explained in the following non-restrictive description of a preferred embodiment of a face-to-face weaving machine with face-to-face shed forming according to the invention.

Figure 2:
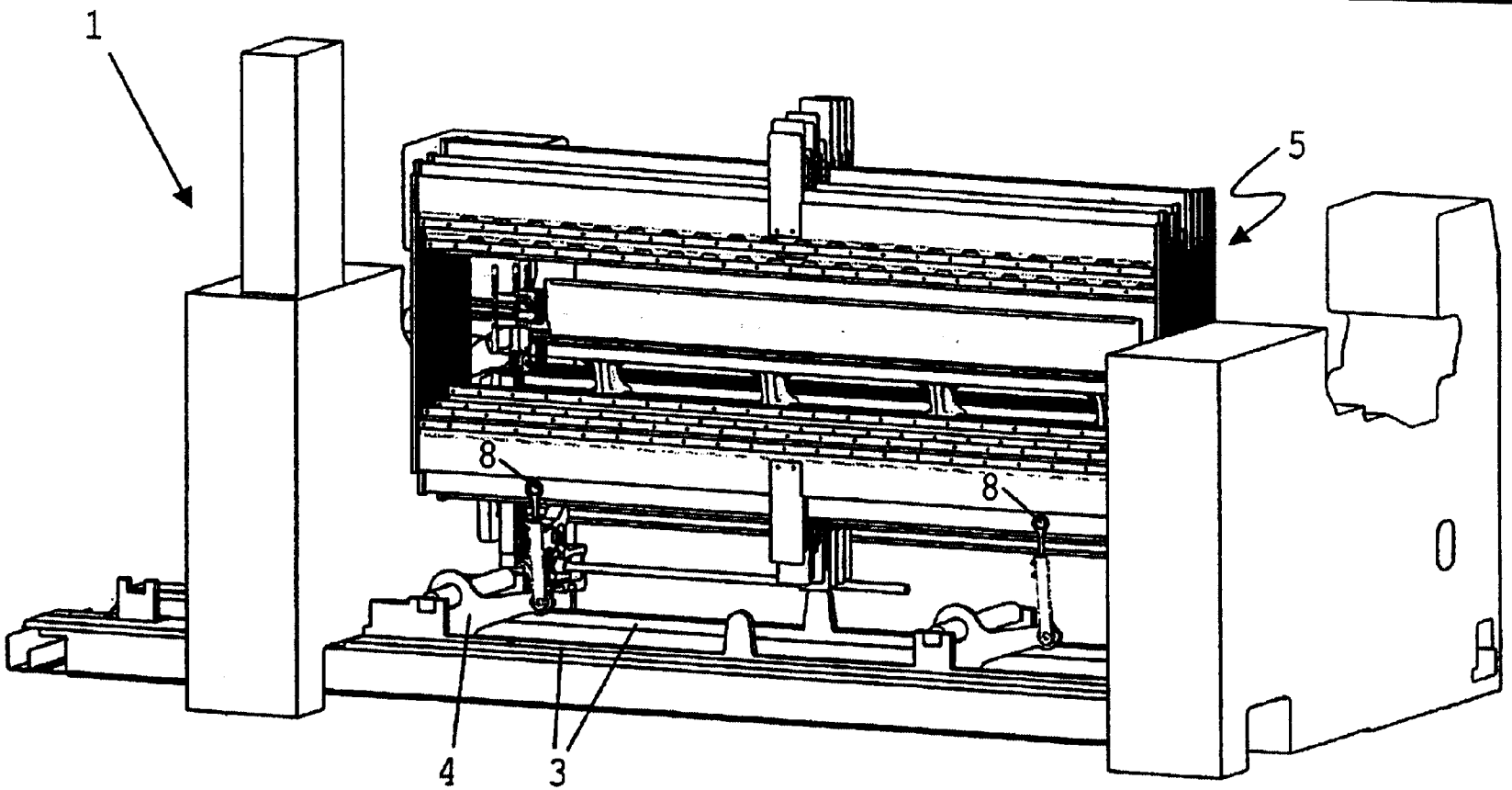

In this description reference is made, by means of reference numbers, to the attached figures, of which FIG. 1 is a side view of a face-to-face weaving machine with face-to-face shed forming without rear traverse;

FIG. 2 is a perspective view of a face-to-face weaving machine with face-to-face shed forming without rear traverse;

The face-to-face weaving machine (1) with face-to-face shed forming according to the invention, as represented in FIGS. 1 and 2, has no rear traverse, while the face-to-face weaving machine (1) is still built in a sufficiently stable way by only providing a front traverse (2) and lower cross beams (3) for the drawing work (4) of the shaft machine. The set of weaving frames (5) is kept in an upright position, with a weaving reed (6) attached to this set and the whole is heddled entirely by means of a holder device brought into the face-to-face weaving machine by a horizontal shift. Removing and inserting the set of weaving frames (5) occurs by loosening and fastening the driving rod big ends (8), which are easily accessible because of the absence of a rear traverse.

What is claimed is:

1. Face-to-face weaving machine wherein the face-to-face weaving machine comprises a weaving reed and a set of weaving frames, the weaving reed being attached to a front of the set of weaving frames, warp yarns heddled on the weaving reed, and means for bringing the set of weaving frames together with the weaving reed heddled completely with the warp yarns into the face-to-face weaving machine by a horizontal shift, in an upright position without any tilting movement.

* * * * *